United States Patent [19]

Hida

[11] Patent Number: 4,969,337

[45] Date of Patent: Nov. 13, 1990

[54] ROTARY CUTTER DEVICE FOR AUGER TYPE ICE MAKING MACHINE

[75] Inventor: Junichi Hida, Toyoake, Japan

[73] Assignee: Hoshizaki Electric Co., Ltd., Toyoake, Japan

[21] Appl. No.: 483,567

[22] Filed: Feb. 22, 1990

[30] Foreign Application Priority Data

Mar. 29, 1988 [JP] Japan ..... 63-40387

[51] Int. Cl.[5] ..... F25C 5/12

[52] U.S. Cl. ..... 62/320; 62/354; 241/DIG. 17

[58] Field of Search ..... 62/320, 354; 241/DIG. 17, 82.5, 186 A, 186 R

[56] References Cited

U.S. PATENT DOCUMENTS 3,196,628 7/1965 Reynolds ..... 62/320 X
3,662,564 5/1972 Clearman et al. ..... 62/320
4,484,455 11/1984 Hida ..... 62/320
4,574,593 3/1986 Nelson ..... 62/320
4,576,016 3/1986 Nelson ..... 62/320

*Primary Examiner*—William E. Tapolcai
*Attorney, Agent, or Firm*—Brooks, Haidt Haffner & Delahunty

[57] ABSTRACT

A rotary cutter for an auger type ice making machine mounted on a rotatable shaft thereof comprises a plurality of cutter blades for cutting ice rods extruded from ice compressing passages into ice pellets or chips. Some of the cutter blades are integrally provided at an upper edge portion thereof with an ice feeding blade having an inclination relative to the center axis of the cutter which is smaller than that of the associated cutter blade. Owing to the provision of the ice feeding blades, the ice chips resulting from the cutting are prevented from staying at the upper edge portions of the cutter blades. As compression of ice between the cutter blades does not effectually take take between the cutter blades, the ice is not unncessarily hardened, facilitating extrusion of ice from the cutter.

10 Claims, 2 Drawing Sheets

ROTARY CUTTER DEVICE FOR AUGER TYPE ICE MAKING MACHINE

BACKGROUND OF THE INVENTION

1. Field of the Invention

This invention generally relates to an auger type ice making machine in which ice layers formed on the inner cylindrical surface of a refrigeration casing are scraped off as a rotary screw shaft with a coiled blade rotated in the casing. More particularly, the invention is concerned with a rotary cutter device mounted on the top of the screw shaft extending upwardly through an extrusion head, which is secured to the upper end portion of the refrigeration casing, for cutting ice rods extruded through the extrusion head into small particles of ice, known commercially as ice chips or pellets.

2. Prior Art

In the ice making machine of the auger type mentioned above, thin ice layers formed on the inner cylindrical surface of the refrigeration casing are scraped therefrom by the coiled blade of a screw shaft rotatably supported by bearings at upper and lower ends thereof and form a semi-solid frozen material. The semi-solid ice mass is fed upwardly through a plurality of ice compressing passages in the extrusion head to be extruded in the form of ice rods from the extrusion head which is securely mounted within the casing, the ice rods then cut into hard ice particles, i.e. ice pellets or chips by a cutter mounted on the screw shaft at the top end thereof. A variety of such ice making machines are known (reference may be made to U.S. Pat. No. 4,484,455, for example).

Further, it is already known that the discharge of the ice chips or pellets resulting from the cutting by the cutter in the ice making machine can be promoted or accelerated by using a cutter having a plurality of radially outwardly extendng, circumferentially spaced fin-like cutter blades (reference may be to Japanese Utility Model Publication No. 61-32306, for example).

When it is desired to obtain fine ice particles by cutting the ice rods with the fin-like cutter blades, a cutter device is employed wherein the cutter blades thereof are circumferentially arranged at a smaller pitch instead of lowering the ice extruding speed by decreasing the rotating speed of the screw shaft, as a reduction in ice extruding speed is unfavorable to ice manufacturing efficiency.

However, when the circumferential pitch of the cutter blades is small, i.e. when the inter-blade space is narrow, the inter-blade spaces become jammed or crammed with fine ice particles, which are then compressed therein to be excessively hardened beyond a desired hardness and may eventually grow to harder particulate ice of a larger size.

Also, conventional auger type ice making machines suffer from other shortcomings. More specifically, referring to FIG. 4 of the accompanying drawings, the ice layers formed on the inner surface of a refrigeration casing (not shown) are scraped off and compressed into ice rods through an extrusion head (not shown), wherein the ice rods are cut by cutter blades 17 of a rotating cutter 13 into ice particles, which are then introduced from a discharge port 22 connected to the casing and through a not shown ice discharge chute into an ice storage bin (not shown). When the discharge port 22 is formed of, for example, a plastic material, harder ice mass in larger particulate form tends to jam in a gap

22*a* between the discharge port wall and the radially outermost ends of the cutter blades 17 to thereby injure or break the discharge port 22 and/or apply an increased load onto the bearings of the screw shaft 2 by way of the cutter blade edge, cutter 13 and screw shaft 2, exerting various adverse influences on the ice making machine, including accelerated abrasion of the bearings and other parts.

SUMMARY OF THE INVENTION

An object of the present invention is therefore to eliminate the above-mentioned shortcomings of the conventional ice making machines by providing a rotary cutter device for an auger type ice making machine, wherein the occurrence of compression of the ice particles between the cutter blades can be substantially suppressed or inhibited while promoting the ice transfer to the discharge port.

With the above object in view, the present invention provides a rotary cutter device adapted to be mounted on a rotating shaft of an auger type ice making machine, the cutter including a plurality of cutter blades for cutting ice rods extruded through compressing passages into ice particles, wherein some of the cutter blades are provided with an ice feeding blade with a smaller inclination relative to the center axis of the cutter than that of the associated cutter blade.

As a result of the presence of the ice feeding blades as mentioned above, no more congestion of ice particles on the radially outermost end portions of the cutter blades can take place, whereby the compression of ice particles between adjacent cutter blades is substantially avoided to allow the ice particles to be easily discharged from the cutter without being excessively hardened. Accordingly, formation of harder ice mass in larger particulate form can be prevented and thus the adverse influences otherwise exerted on the ice making machine as previously described can be positively suppressed.

BRIEF DESCRIPTION OF THE DRAWINGS

A more detailed understanding of the present invention may be had from the following description of a preferred embodiment thereof, given by way of example and to be read and understood in conjuction with the accompanying drawings, in which.

DETAILED DESCRIPTION OF THE PREFERRED EMBODIMENT

Figure 1:
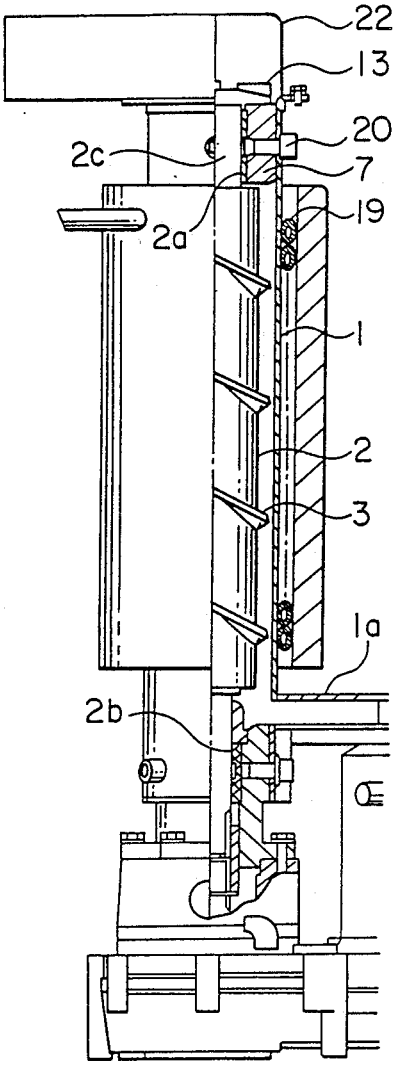
FIG. 1 is a schematic elevational view showing, partly in section, an auger type ice making machine with a rotary cutter device according to an exemplary embodiment of the invention.

Referring to the drawings, particularly in FIG. 1, there is shown a structure within a refrigeration casing 1 of an auger type ice making machine equipped with a rotary cutter assembly according to an embodiment of the invention. Wound on the outer cylindrical surface of the casing 1 in a known manner is a refrigerating pipe 19 through which a coolant is forced to flow by means of a refrigeration system (not shown), while raw water to be iced is supplied into the interior of the casing 1, whereby thin ice layers are formed over an inner cylindrical surface thereof. A screw shaft 2 having a coiled blade 3 formed integrally therewith is disposed within the casing 1 and supported rotatably upper and lower sleeve-like bearings 2*a* and 2*b*. As the screw shaft 2 rotates, the screw blade 3 scrapes off the thin ice layers formed on the inner surface of the casing 1 while feeding upwardly the semi-solid ice layers removed therefrom.

Figure 2:
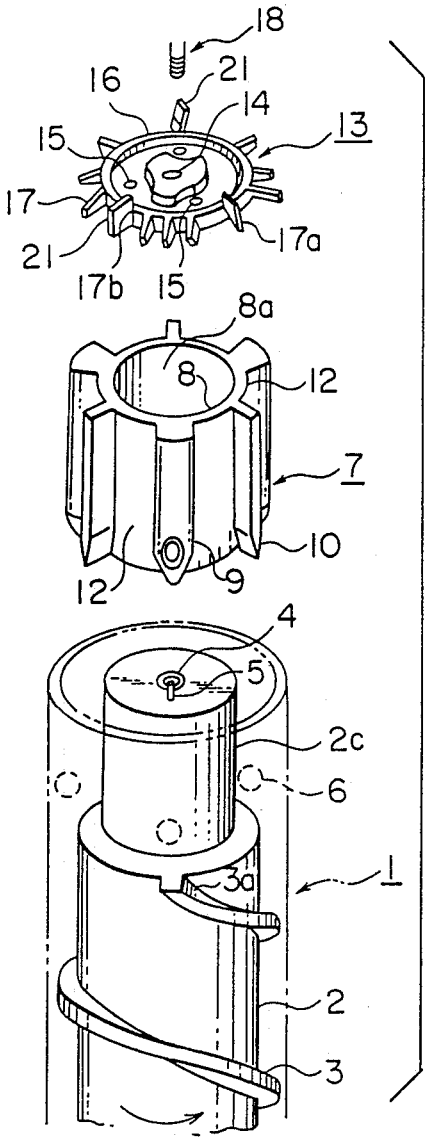
FIG. 2 is an exploded perspective view showing essential portions of the ice making machine shown in FIG. 1.

As shown in more detail in FIG. 2, the screw shaft 2 has an upper end portion 2*c* which is reduced in diameter as compared with the remaining portion of the screw shaft 2, allowing the upper end portion 2*c* to be inserted through an extrusion head 7. The extrusion head 7 secured to the refrigeration casing 1 serves to compress the semi-solid ice layers, which are transported upwardly through the casing by the screw blade 3. Formed in the top of the upper end portion 2*c* of the screw shaft 2 is a bolt receiving hole 4 used for securing a cutter 13 disposed above the extrusion head 7 to the screw shaft 2. Further, a vertically extending pin 5 is provided on the upper end portion 2*c* for positioning the cutter 13 at a predetermined circumferential position with respect to the screw shaft 2. This pin 5 is axially aligned with the topmost end 3*a* of the screw blade 3 and determines, in cooperation with pin receiving holes 15 as mentioned below, which cutter blades 17 of the cutter 13 are to be used. Three holes 6 are formed through the wall of the casing 1 for receiving bolts 20 (see FIG. 1) therein to fixedly secure the extrusion head 7 to the casing 1.

The extrusion head 7 includes a substantially cylindrical main body 8 having an axial bore 8*a* for receiving therein the upper end portion 2*c* of the screw shaft 2 as well as three thick protrusions 9 and three thin protrusions 10 which are disposed alternately with each other on the outer cylindrical surface of the main body 8 with a space intervening between the adjacent protrusions 9 and 10 in the circumferential direction. Each of the protrusions 9 and 10 extends in the axial direction and has a tapered lower end portion. Each space between the adjacent protrusions 9 and 10 defines an ice compressing passage 12 within which the semi-solid ice layers are compressed to be dewatered in the course of passing therethrough to be thereby formed into an ice rod (i.e. rod-like ice solid).

Figure 3A:
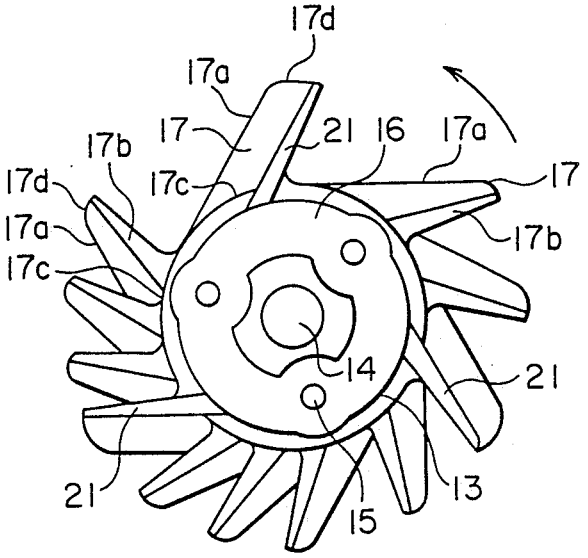
FIG. 3A is a plan view showing the rotary cutter device according to the invention.

As best shown in FIG. 3A, the cutter 13 positioned above the extrusion head 7 includes a disc-like cutter blade supporting member 16 having a hole 14 formed therethrough for receiving a bolt 18 (FIG. 2) and the above-mentioned three pin receiving holes 15 in which the pin 5 is selectively engaged, and a plurality of spaced cutter blades 17 fixedly mounted on the outer periphery of the cutter supporting disc 16 in a radial pattern. Each cutter blade 17 is fixedly connected to the disc 16 at a base edge portion 17*c* located innermost as viewed in the radial direction and extends radially outwardly from the base edge portion 17*c* to terminate in a tip edge portion 17*d*, wherein the base edge portion 17*c* is inclined relative to the axis of the cutter so that the lower end of the base edge portion 17*c* is located upstream of the upper end of the base portion 17*c* as viewed in the rotational direction of the cutter 13 indicated by an arrow. All the other cutter blades may be inclined in a similar manner.

Further, as best shown in FIG. 3A, three of the cutter blades 17 are formed integrally with an ice feeding blade 21 having a smaller angle of inclination relative to the axis of the cutter than that of the associated cutter blade in such a manner that the ice feeding blade 21 extends upwardly from the upper edge portion 17*b* located upstream of the lower edge portion 17*a* of the cutter blade 17 as viewed in the rotational direction of the cutter 13.

The cutter 13 is fixedly mounted on the screw shaft 2 by threadedly engaging the bolt 18 through the hole 14 into the bolt receving hole 4 of the screw shaft 2 so that the cutter 13 can rotate with the screw shaft 2.

In operation, the casing 1 is supplied with raw water to be iced from a not shown water supply system through an inlet port 1*a*, whereby thin ice layers are formed on the inner cylindrical surface of the casing 1 under the action of the coolant flowing through the refrigerating pipe 19. The thin ice layers thus formed are scraped from the inner casing surface and the resulting semi-solid ice is transported upwardly by the screw blade 3, as the screw shaft 2 rotates, to enter the ice compressing passages 12 each defined between the adjacent thick and thin protrusions 9 and 10 in the extrusion head 7. The semi-solid ice entering the ice compressing passages 12 is compressed under the pressure exerted by the succeeding semi-solid ice being transported generally consecutively into the passages 12 by the action of the rotating screw blade 3, whereby the semi-solid ice is dewatered to be transformed into solid ice rods. Since the cutter 13 positioned above the extrusion head 7 rotates with the screw shaft 2, the ice rods leaving the ice compressing passages 12 of the extrusion head 7 are cut into ice particles, i.e. ice chips or pellets by the cutter blades 17.

Since the ice rods are extruded essentially from two adjacent ice compressing passages 12, although this depends on the ice making capability of the machine, the length at which the ice rod is cut is determined by the number of cutter blades 17 above these ice compressing passages 12. On the other hand, the number of cutter blades 17 can adjustably be determined depending on which of the three pin receiving holes 15 the pin 5 (FIG.2) is inserted in. Thus, when a greater number of cutter blades 17 is selected with the pitch thereof being correspondingly reduced, i.e. when the space between the cutter blades is adjusted to be narrow, the time interval at which the ice rod is cut is correspondingly shortened, which in turn means that the ice particles resulting from the cutting of the ice rod are thin. On the contrary, when a smaller number of cutter blades 17 are selected with the pitch thereof being increased, i.e. when the distance or space between the cutter blades is set wide, the time interval at which the ice rod is cut is lengthened, resulting in thick ice particles.

As will be understood from the foregoing, the pitch of the cutter blades 17 is decreased when ice particles of a small size are to be produced. Consequently, there may arise situations in which the ice is excessively compressed between the cutter blades 17 and hardened to an unnecessary extent, eventually bringing about jamming or blocking in the worst case.

Figure 3B:
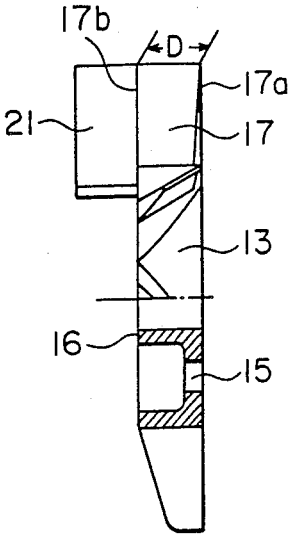
FIG. 3B is a side elevational view showing, partly in section, a part of the rotary cutter shown in FIG. 3A.

In this conjuction, it is noted that according to the preferred embodiment of the invention, the axial thickness D (FIG. 3B) of the cutter supporting member 16 of the cutter 13 employed in the illustrated ice making machine is significantly reduced by abuot half that of a cutter support member employed heretofore. By virtue of this feature, the passage between adjacent cutter blades 17 is relatively widened in terms of the volume of the space defined between the cutter blades for a given pitch, whereby the possibility of jamming of the ice can be correspondingly reduced. For the same effect, according to a preferred embodiment of the invention, the radially outermost tip edge of a cutter blade 17 not provided with the ice feeding blade 21 is tapered such that the axial dimension of the tip edge is smaller than that of the radially innermost base edge. Further, the thickness (dimensions in the circumferential direction) of the cutter blades 17 as well as of the ice feeding blades 21 decreases progressively toward their respective tip edges. Besides, the region of each cutter blade 17 in which the lower edge portion 17*a* and the tip edge portion 17*d* join together is rounded so that the worker can be protected against accidental injury when handling the cutter 13 such as during assembly thereof.

On the other hand, a cutter blade 17 which is provided with the ice feeding blade 21 has substantially constant dimensions in the axial direction from the base edge portion to the tip edge portion thereof. Similarly, the ice feeding blade 21 has a substantially uniform axial dimension.

Incidentally, it should be mentioned that when the thickness (axial dimension) of the cutter blade supporting member 16 is reduced with the tip edge portion of the cutter blade being tapered, the capability of the cutter blade 17 to feed the ice is extremely reduced. Accordingly, unless the ice feeding blade 21 described above is provided, the ice will tend to stay above the cutter 13 while rotating without being fed forwardly.

The function of the ice feeding blade 21 is to feed or transfer the ice and it is unnecessary to vary the number of the ice feeding blades according to the desired pellet size as in the case of the cutter blades 17. Further, provision of a greater number of ice feeding blades 21 will not proportionately enhance the ice feeding action. The cutter 13 shown in FIG. 3A has three ice feeding blades 21 provided at substantially equal distance in the circumferential direction. In effect, this number and arrangement of the ice feeding blades are sufficient for practical applications.

It has experimentally been established that the ice feeding blade 21 may extend upwardly substantially in the vertical direction from the upper edge portion 17*b* of the cutter blade 17 as shown or alternatively it may extend upwardly at a smaller angle of inclination than that of the cutter blade. Further, the surface area of the ice feeding side of the blade 21 should preferably be substantially the same as that of the associated cutter blade 17.

Dimensions of the major portions of the cutter 13 according to a preferred embodiment of the invention are shown below, by way of example only, in comparison with those of the prior art cutter.

| | Prior Art | Invention |
|---|---|---|
| Axial dimension of blade support disc | 20 mm | 10 mm |
| Axial dimension of cutter blade base edge | 20 mm | 10 mm |
| Thickness of cutter blade base edge | 3 mm | 3 mm |
| Thickness of cutter blade tip edge | 3 mm | 1 mm |
| Axial dimension of tip edge of cutter blade without ice feeding blade | 10 mm | 5 mm |

-continued

| | Prior Art | Invention |
|---|---|---|
| Axial dimension of ice feeding blade | — | 10 mm |
| Thickness of ice feeding blade base edge | — | 3 mm |
| Thickness of ice feeding blade tip edge | — | 1 mm |

Figure 4:
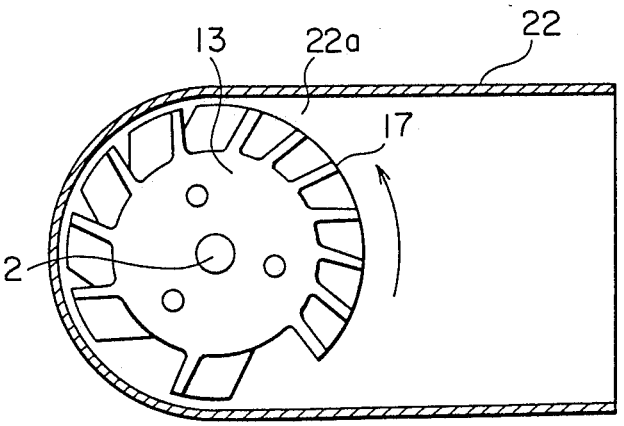
FIG. 4 (PRIOR ART)
FIG. 4 is a fragmental plan view showing, partly in section, a positional relationship between a rotary cutter and an ice discharge port in an ice maker known heretofore.

As a result of using the cutter 13 having the cutter blades 17 provided with the ice feeding blade 21, ice chips or pellets of a small size can be smoothly transferred into an ice storage chamber (not shown) through the discharge port 22 (see FIG. 1). Further, because of ice hardness which is not remarkably high, any ice rod caught in the gap 22*a* (see FIG. 4) formed between the discharge port 22 and the cutter blade 17 or the ice feeding blade 21 is immediately crushed without injuring or damaging the discharge port. Also, the load applied to the screw shaft 2 and the bearings therefor is reduced, resulting in less abrasion of the bearings.

As will now be appreciated from the foregoing description, by virtue of such structure of the cutter according to the invention in which some of the cutter blades are each integrally provided at the upper edge portion thereof with an ice feeding blade at an inclination relative to the axis of the cutter which is smaller than that of the cutter blade, the ice is positively prevented from staying or congesting at the exist of the cutter, withuot being compressed between the cutter blades and unnecessarily hardened excessively, whereby the ice making machine can be protected against adverse influences otherwise exerted by the ice.

It is thought that the present invention will be undertood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. A rotary cutter device for an auger type ice making machine, comprising a plurality of cutter blades for cutting at least an ice rod extruded from at least one ice compressing passage into ice pellets, wherein each of said cutter blades has upper and lower edge portions disposed at such an inclination relative to the center axis of the cutter device that said lower edge portion lies downstream of said upper edte portion with respect to a direction of rotation of said cutter device, characterized in that at least one of said cutter blades is integrally provided at said upper edge portion thereof with an ice feeding blade extending upwardly from said upper edge portion at an angle of inclination relative to said center axis of said cutter device which is smaller than that of said associated cutter blade.

2. A rotary cutter device as set forth in claim 1, characterized in that three of said plurality of cutter blades are provided with said ice feeding blades, respectively, said ice feeding blades being spaced from one another in the circumferential direction at a substantially equal distance.

3. A rotary cutter device as set forth in claim 1, characterized in that said ice feeding blade extends substantially vertically from said upper edge portion of said associated cutter blade.

4. A rotary cutter device as set forth in claim 1, wherein said cutter device includes a disc-like cutter supporting member having a cylindrical peripheral surface, a top surface and a bottom surface both of which are connected to upper and lower ends of said cylindrical peripheral surface, respectively, and wherein each of said cutter blades further includes base and tip edge portions between which each of said upper and lower edge portions extends, said base edge portion being connected to said peripheral surface of said supporting member with an inclination relative to said center axis of said cutter device, whereby said cutter blade is inclined relative to said center axis of the cutter.

5. A rotary cutter device as set forth in claim 4, characterized in that said cutter blade has a dimension in the circumferential direction which is gradually decreased from said base edge portion to said tip edge portion, and that said ice feeding blade has a dimension in the circumferential direction which is gradually decreased correspondingly to that of the associated feeding blade.

6. A rotary cutter device as set forth in claim 4, characterized in that a region of said cutter blade where said lower edge portion and said tip edge portion join together is rounded.

7. A rotary cutter device as set forth in claim 4, characterized in that the cutter blade without said ice feeding blade has an axial length of said tip edge portion which is shorter than that of said base edge portion.

8. A rotary cutter device as set forth in claim 7, characterized in that said lower edge portion of said cutter blade extends on the substantially same plane as that of said bottom surface of said cutter supporting member, and that the axial length of said tip edge portion is formed shorted than that of said base edge portion by inclining said upper edge portion downwardly in the radially outward direction.

9. A rotary cutter device as set forth in claim 4, characterized in that the axial dimensions of the cutter blades each provided with said ice feeding blade are substantially the same in length from the base edge portion to the tip edge portion thereof, and that the axial dimentions of said ice feeding blades are substantially the same in length from the base edge portion to the tip edge portion thereof.

10. A rotary cutter device as set forth in claim 9, characterized in that said ice feeding blade has substantially the same axial dimensions as that of said associated cutter blade.

* * * * *